United States Patent [19]

Wilbur et al.

[11] 3,944,872

[45] Mar. 16, 1976

[54] RADIO FREQUENCY NOISE GENERATING MAGNETRON

[75] Inventors: Donald A. Wilbur, Troy; Philip H. Peters, Jr., Schenectady, both of N.Y.

[73] Assignee: General Electric Company, Schenectady, N.Y.

[22] Filed: Aug. 11, 1952

[21] Appl. No.: 303,726

[52] U.S. Cl. ..... 315/39.51; 313/341; 331/78

[51] Int. Cl.[2] ..... H01J 25/50

[58] Field of Search ..... 250/36; 315/1.204, 1.205, 315/39, 40, 39.51, 53, 55, 57, 59, 65, 67, 69, 71, 73, 77; 332/5; 313/341

[56] References Cited

UNITED STATES PATENTS

| | | | |
|---|---|---|---|
| 2,103,338 | 12/1937 | Posthumus | 250/36 |
| 2,154,758 | 4/1939 | Dallenbach | 315/1.204 |
| 2,597,506 | 5/1952 | Ludi | 315/40 |

*Primary Examiner*—T. H. Tubbesing
*Assistant Examiner*—Nelson MosKourtz
*Attorney, Agent, or Firm*—Jerome C. Squillaro; Joseph T. Cohen

EXEMPLARY CLAIM

1. A magnetron discharge device for noise generation comprising an elongated cathode and a plurality of anode segments surrounding said cathode to define a cylindrical space charge chamber, said cathode comprising a helix having a diameter equal to at least half the space charge chamber diameter and having a spacing between adjacent turns equal to at least half the helix diameter.

14 Claims, 9 Drawing Figures

Inventors:
Donald A. Wilbur,
Philip H. Peters, Jr.,
by Paul A. Frank
Their Attorney.

Inventors:
Donald A. Wilbur,
Philip H. Peters, Jr.,
by Paul A. Frank
Their Attorney.

RADIO FREQUENCY NOISE GENERATING MAGNETRON

Our invention relates to magnetrons for producing high frequency noise signals.

Radio frequency noise has been commonly used to jam enemy radar. Noise in this sense is understood to refer to an electrical signal having components which vary randomly in frequency and amplitude in a frequency band including the frequency of the signal to be jammed. A common method employed for producing such noise at satisfactory power level has required wide band amplification of the output of a low level noise source, which output signal is then employed to amplitude modulate a magnetron oscillator. However successful such a jamming equipment, it obviously requires a relatively complex apparatus. In aircraft installations especially, where bulk and weight must be minimized, the amount of equipment required for the separate noise source and the associated amplifiers and modulation equipment limits the feasibility of jamming equipment installation.

It is an object of our invention to provide a simple and efficient means for generating radio frequency at substantial power levels with a minimum amount of equipment.

It is another object of our invention to provide a magnetron discharge device for the generation of high frequency noise signals.

According to our invention, a magnetron of the type having a plurality of spaced anode segments surrounding an elongated cathode to define a cylindrical space charge chamber is employed to generate radio frequency noise at substantial power levels of the same order of efficiency as may be obtained for coherent oscillation. For this purpose the electric field symmetry between the cathode and anode assembly is distorted in such a way that a high level of noise power can be generated in an applied voltage range below that necessary for coherent oscillation. This is achieved by varying the symmetry of the cathode with respect to the anode assembly so that the effective spacing between them varies axially and circumferentially in the space charge chamber.

Before proceeding to a detailed description of apparatus embodying our invention, a brief consideration of the nature of noise magnetron operation is pertinent. In a conventional magnetron oscillator of the traveling wave type, whether the magnetron device be one having a number of individual anode segments or vanes which are connected to a resonant circuit or circuits or whether it is one in which the anode segments are part of the anode block in which a plurality of cavity resonators are incorporated, the resonant system is excited by the properly timed or synchronized passage of bunches of electrons past the anode segments. The average velocity of electrons past each segment determines the gap-to-gap transit time. In the pre-oscillation period of a magnetron when oscillations are being initiated, it is believed that the random movement of some of the electrons of the rotating space charge helps to start oscillations over a band of frequencies in the resonant system. The net effect of all the random excitation of the various resonators or parts of the resonator circuit is described as high frequency noise. When additional voltage is applied to the magnetron anode segments, the amplitude of the individual high frequency fields increases. This results in the phase-focusing and synchronization of the space charge required for coherent oscillation. Conventional magnetrons are designed to produce maximum power output and efficiency for coherent oscillation and minimum noise-to-signal ratio. While noise oscillations have been observed in such magnetrons, the noise power has been but a very small fraction of the total power output. It has heretofore been assumed impossible as well as undesirable to obtain a substantial noise output from a magnetron oscillator, and, a more adequate theory and explanation of the general principles of magnetron operation as directed to the increase of noise output have not been available.

The production of noise may be satisfactorily explained, so far as understanding of our present invention is concerned, by considering the relative spacing and configuration of the different parts of the cathode with respect to each other and the anode assembly in terms of the resulting large number of angular and axial variations of the electric field between the cathode and anode. The asymmetry of the electric field results in variations of the transit times of the bunched electrons under the gaps between the anode segments. The net effect of changes in magnetron construction for the production of a substantial noise output may thus be viewed as increasing the width of the band of pre-oscillation noise frequencies, thus rendering synchronization of the high frequency voltages more difficult so that substantially only a noise output is obtained at the rated power input to the magnetron, the ratio of noise to coherent oscillation being so large so as to render the coherent signal unrecognizable. Reference is also made to our related application, Ser. No. 303,725 filed Aug. 11, 1952 (concurrently herewith) and assigned to the assignee of the present invention, where variations in the sizes of the anode segments and anode gaps is utilized in the generation of high frequency noise, as described and claimed therein.

The features of the invention desired to be protected herein are pointed out in the appended claims. The invention itself together with its further objects and advantages, may best be understood by reference to the following description taken in conjunction with the accompanying drawing in which FIG. 1 represents a view, partly in section, of a magnetron discharge device and circuit connection therefor embodying the principles of the invention;

Figure 1:
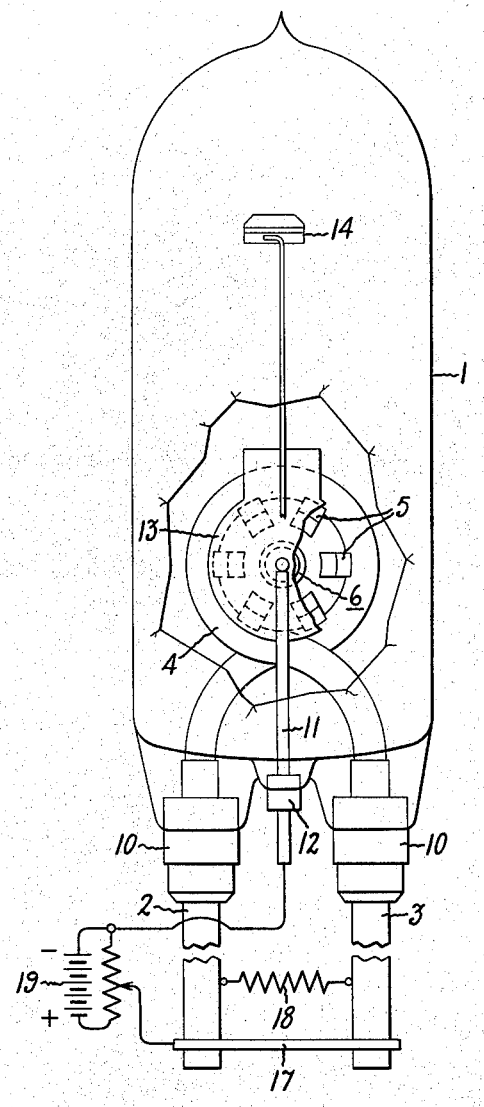
Figure 2:
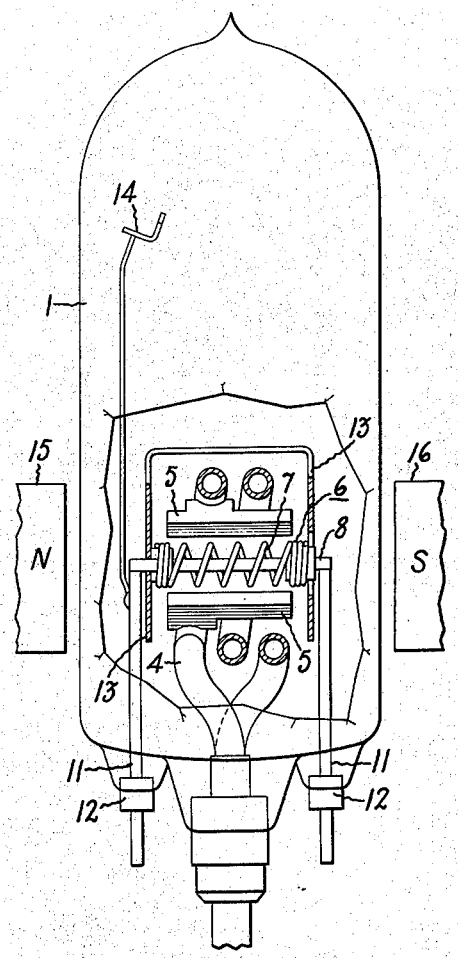
FIG. 2 is another view, partly in section, of the device of FIG. 1.

Referring now to FIGS. 1 and 2, a magnetron structure of the interdigital type is shown as modified for noise generation. Except for the cathode and its dimensions with respect to the anode, the specific magnetron structure shown corresponds to that described and claimed in U.S. Pat. No. 2,521,556, issued Sept. 5, 1950, to Donald A. Wilbur and assigned to the assignee of the present invention.

In this type of magnetron a hermetically sealed envelope 1, suitably made of glass, encloses a part of a resonant circuit such as the transmission line section comprising parallel connectors 2 and 3 which extend through the base of the envelope 1 and a two-turn spiral coil 4 which terminates the connectors. Within the spiral coil 4 are provided a plurality of anode electrodes 5, each of which is conductively supported from a different point on the inner periphery of the spiral as by welding thereto. These anode electrodes, also commonly called segments or vanes, define a generally cylindrical chamber between their inner surfaces which is coaxial with the centrally disposed elongated cathode assembly 6.

Figure 4:
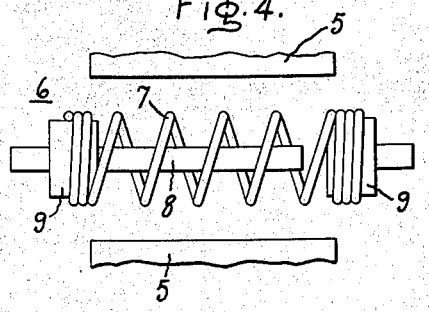
FIG. 4 is an enlarged side view of the electrode structure of FIGS. 1 and 2, and FIGS. 5, 6, 7, 8 and 9 are side views of magnetron electrode structures representing modifications.

According to our invention the cathode 6 is designed to provide an unsymmetrical electric field distribution within the space charge chamber when a potential is applied between the anode and cathode assemblies. As shown in FIGS. 1 and 2 and as particularly illustrated in FIG. 4, which is drawn substantially to scale, the cathode comprises a wide pitched spiral tungsten wire coil or helix 7 and a centrally disposed conductive rod 8 within the coil. The ends of the helix are mounted and conductively secured on conductive support disks or cylindrical sections 9. The conductive rod 8 is conductively supported from one of the end disks and spaced from the other so that it will not short circuit the helix. The diameter of the helix is at least half the inside diameter of the space charge chamber and the pitch of the helix is over half the helix diameter. The diameters of the conductors from which the coil 7 and the rod 8 are formed are also relatively small compared to the diameter of the helix. To provide the magnetron space charge, the spiral coil 7 is heated to a suitable temperature by means of electrical circuit. No emission is required from the central rod 8 since it is primarily employed for its effect as a field-shaping electrode rather than as a source of electrons. The rod 8 is shown as extending substantially the length of the helix but may be shortened to provide additional axial asymmetry.

Referring again to FIGS. 1 and 2 for an illustration of the structural features of the magnetron, suitable glass-to-metal seals 10 surrounding the lines 2 and 3 permit them to be hermetically sealed to the envelope wall. Similarly, conductive connections are made to the respective cathode disks 9 by a pair of upright conductive rods 11 which also pass through the envelope base at similar glass-to-metal seals 12 to provide external terminals.

To forestall destructive bombardment in the envelope 1 by electrons escaping from the space charge chamber a cathode end shield arrangement 13 having end members positioned near the ends of the space charge chamber defined by the anode segment array is provided. This end shield assembly is suitably positioned and supported from one end disk 9 of the cathode. A suitable getter is provided on a getter support 14 which is suitably supported from one of the cathode support rods 11. The getter is flashed according to well known techniques during evacuation of the envelope.

Figure 3:
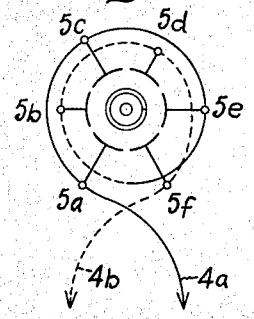
FIG. 3 is a schematic representation of the electrode structures of FIGS. 1 and 2.

As may be seen more clearly in FIG. 3, the array of six anode segments 5, further identified separately as segments 5*a* to 5*f*, is connected so that adjacent segments may be at opposing high frequency potentials when the resonant circuit including the spiral coil is excited at its resonant frequency.

Accordingly, one set of alternate segments, namely 5*a*, 5*c* and 5*e*, are connected to the first turn of the coil which is indicated schematically in solid line as 4*a* in FIG. 3 and the other set of alternate segments 5*b*, 5*d*, and 5*f* are connected to the other turn 4*b*, which is indicated in dotted line. When one lengthwise half of the coil becomes electrically positive, the other half is negative, and the segments of the anode array are alternately positive and negative, corresponding to the usual pi mode of excitation. Other means of interconnecting anode segments to a resonant circuit or circuits may be utilized instead, this particular anode construction being exemplary of magnetron arrangements in which our invention may be incorporated.

In operation a static magnetic field is provided in the space charge chamber parallel to the axis thereof. Means for providing such a field is illustrated in FIG. 2 as the north and south poles 15 and 16 respectively of a permanent magnet positioned outside the envelope and aligned with the cathode. Other means of providing the magnetic field, such as a solenoid winding, may of course be substituted. To provide the space charge in the space charge chamber a suitable source of heater voltage is provided between the cathode terminals 11, the amount of current being regulated to provide a high cathode temperature for large or heavy electronic emission.

As further shown in FIG. 1, the resonant circuit to which the anode circuits are coupled as previously described is tuned to the desired frequency by positioning a short-circuiting conductor 17 between conductors 2 and 3 at the desired position along the length thereof. A load 18, schematically indicated as a resistor, is also coupled between the conductors 2 and 3. To provide a radial electric field in the space charge chamber a source of direct current voltage 19 is connected between the cathode and anode assemblies.

The radial electric field, together with the axial magnetic field, imparts a generally rotating motion to the electronic space charge so that it assumes an average angular velocity about the cathode. In a conventional magnetron, where the cathode is a cylindrical sleeve coaxial with the space charge chamber axis or where a close wound cathode helix is employed, the unidirectional field between the cathode and the anode is symmetrical about the cathode and does not substantially vary along the loci of points parallel to the space charge chamber axis. In such conventional magnetrons the initial random or noise excitation of the resonant circuit coupled to the anode segments establishes high frequency fringing electric fields between the segments with which the space charge interacts, and at useful output power levels the space charge is bunched or focused in phase so that in-phase or useful electrons crossing the anode gaps in the direction of the fringing high frequency field give up some of their kinetic energy to that field, while the out-of-phase electrons are accelerated and return to the cathode. Under such conditions, the space charge is synchronized with alternating fields of the anode assembly so that any given bunch of in-phase electrons of the rotating space charge arrive at each interaction gap in phase with the alternating field in the gap region. As the applied voltage between the anode and cathode is increased beyond the point where such coherent oscillation begins, the electronic space charge locally tends to exceed the synchronous velocity with the result that more energy is transferred from the direct current source through the space charge to the alternating fields of the resonant output system. For high power an anode voltage in excess of that voltage required for initiating of oscillation is provided. The output circuit impedance is also kept sufficiently high to facilitate power transfer to the desired load and to prevent attenuation of the alternating electric field below a value necessary for effective synchronization of the rotating space charge.

According to our invention the production of useful high frequency noise is facilitated by the asymmetry of the interaction space between the cathode and anode assembly. This results in distortion of the radial d-c electric field when a voltage is applied between the cathode and anode assemblies with the result that various velocities are imparted to the electronic space charge in different parts of the space charge chamber. Since the cathode diameter is large and the pitch between adjacent turns is large, this distortion of the field is not restricted to the immediate area of the cathode but extends substantially throughout the space charge chamber. As a result, the velocities of the space charge across the various gaps is not uniform and the space charge is not readily phase focused or synchronized to a single output frequency. Instead the various random oscillations produced by the unsynchronized space charge are maintained without falling into a coherent oscillation pattern even when the applied anode voltage is increased to produce the power output corresponding to the output rating of a conventionally arranged magnetron of the same anode dimensions.

While the exact limits of the cathode configuration necessary for producing noise according to our invention are not readily defined since a small amount of some noise is inherent in conventional magnetrons, the successful practice of our invention does not require that certain conditions be observed in order that a substantial noise output may be obtained. Accordingly, both a large number of asymmetrical field deviations as well as the degree of asymmetry is important. As previously mentioned, this is achieved by providing both a relatively large cathode diameter, at least half the diameter of the space charge chamber, and providing a substantial spacing between turns of the cathode helix, the pitch being more than half the cathode diameter. Since the cathode helix is relatively open it does not act solely as a single cylindrical cathode of either the helix diameter or of the wire diameter so far as the field distribution is concerned. Instead, discrete portions of the cathode are at different distances from the nearest portion of the anode assembly, thus in effect producing regions of various cathode diameter to anode diameter ratios distributed both axially along the cathode and circumferentially about it. The applied anode voltage level corresponds to that required for a cylindrical cathode having a diameter equal to that of the helix, the wide pitch accompanying the large diameter prevents the electric field uniformity and coherent oscillation power which would accompany the cylindrical cathode. The center cathode rod 8 is believed to add to the complexity of the radial field distortion and thereby enhance the noise generation.

For optimum extension of the noise producing range of noise generators embodying our invention, the cathode emission and the output circuit characteristics must also be controlled as described in the following paragraphs.

Assuming a given electric field condition in the magnetron of FIGS. 1, 2, and 3, the difficulty of phase focusing the space charge and of synchronizing the space charge bunches increases with the space charge density. Accordingly, it is desirable that the cathode emission be heavy in order to maintain noise production as the power input to the magnetron is increased. This may suitably be achieved by various well-known means, such as by increasing the temperature of the thermionic cathode.

Conversely, assuming a given space charge, synchronization is forestalled by preventing the voltage amplitude of the induced noise signal components from building up to a high value as the input power is increased. One way in which this may be accomplished is by increasing the resistive loading of the tuned output circuit, as by decreasing the resistance of resistor 18 of FIG. 1 to a value below that employed for high power coherent oscillations of a conventional magnetron, or by suitably changing the resistor position on the resonant circuit. Such an output circuit is characterized as a high decrement circuit since its stored energy is rapidly dissipated, and its bandwidth or breadth of tuning is also necessarily increased as a result of the loading. Another way in which the production of noise is maintained is by increasing the bandwidth through addition of rearrangement of the reactive components of the output system, as by a filter means or multiple tuned circuits. In this case the circuit could have both a low decrement and a broad bandwidth. The nature of the production of the noise is believed to differ to some extent according to whether the decrement is high or low. Since in either extreme or for an intermediate case the output circuit is not sharply tuned, the circuit is believed aptly described as broadly tuned.

The concept which is believed to be properly descriptive of the mechanism of noise generation also further explains the output circuit requirements for high power noise generation. During the pre-oscillation period the random excitation of the resonant system may result in simultaneous excitation of the resonant system at different frequencies, within its bandwidth, the oscillations also differing in phase and amplitude. This may readily occur since the electrons of the space charge under the excitation gaps may have many different velocities due to the complex electric field distribution and since the resonant output circuit is tuned sufficiently broadly to permit response to a band of frequencies on either side of the center frequency. If the circuit has a high energy decrement rate, the energy supplied to the circuit is dissipated at a relatively high rate, the resultant excitation by the space charge at all these frequencies tends to produce a net voltage of zero for a time long enough for the circuit oscillations to be damped out. There is, therefore, no high frequency anode voltage to maintain that particular space charge configuration. Thus, before oscillations have an opportunity to build up and cohere at a particular frequency, they are damped out, permitting other unrelated oscillations to start and be damped.

If the resonant output circuit has a low decrement rate and a sufficient bandwidth, the noise oscillations tend to shift in frequency as they attempt to build up, the stored energy of the output circuit being available to support noise oscillations of different frequencies. This introduces frequency modulation components into the noise output signal. Then the various frequency components of the space charge need alter only the rate of exchange of energy between the capacitance and inductance of the output circuit. Since the frequency and rate of change of frequency are random, the frequency modulation components vary randomly and may be used to jam receiving devices sensitive to frequency modulated signals. The impedance of the low decrement circuit may readily be established at a sufficiently high value for maximum power transfer.

Figure 5:
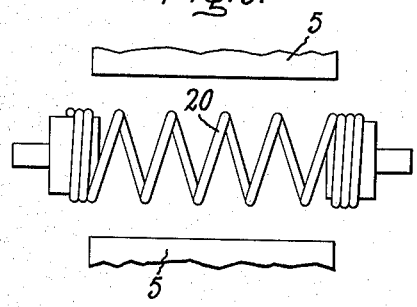

Referring now to FIG. 5, a modification of the cathode assembly employed in FIGS. 1, 2 and 3 is illustrated in which the cathode assembly 6 is replaced by a cathode helix 20 without the center rod 8. Cathode end support disks are employed as previously described and the spacing of the cathode with respect to the anode is illustrated by the facing surfaces of a pair of anode segments 5. The distance between the anode segments represents the diameter of the space charge chamber. As in FIG. 4, the cathode helix pitch is somewhat over half the outer diameter of the cathode and the cathode outer diameter is more than half the anode or space charge chamber diameter. Accordingly, since the helix is relatively open, the electric field varies both axially and circumferentially in the space charge chamber with a potential applied between the cathode and the anode assembly.

This construction is simpler than that previously described in view of the elimination of the center rod, and with such an arrangement satisfactory noise outputs have been obtained. For example, in an exemplary structure the anode array had a length of 0.875 inches and an inside diameter of 0.500 inches, and a cathode was employed with wire 0.030 inches in diameter wound in a helix having 0.325 inches outer diameter and a pitch between turns of 0.166 inches. With such a structure noise outputs up to 500 watts with a bandwidth from 5 to 10 megacycles have been observed at a 500 megacycle per second operating frequency.

Figure 6:
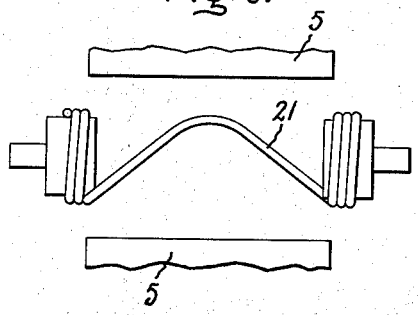

FIG. 6 illustrates another cathode modification differing from that of FIG. 5 in that the pitch of the helix 21 is so large as to provide only one turn for the entire cathode length. This represents the limiting condition for the helix pitch, the applied anode voltage level for useful noise outputs corresponding to that applied to obtain coherent oscillations in a conventional device of the same dimensions having a cylindrical cathode with a diameter equal to that of the helix 21. The diameter of the cathode helix wire itself is relatively small so that the cathode would not function efficiently as a straight-wire centrally disposed cathode. Thus, it may be seen that some of the properties of a helix are obtained insofar as the relatively large diameter cylindrical envelope of the helix is concerned, while at the same time the helix pitch is relatively wide to permit effective field variations.

Figure 7:
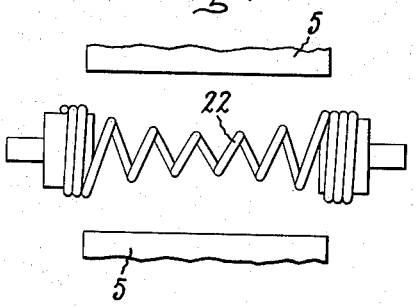

FIG. 7 illustrates another embodiment differing from that of FIG. 5 in which the cathode helix 22 has a changing diameter, in this particular embodiment being shown as of maximum diameter near the ends corresponding to the diameter of the cathode helix of FIG. 5, and decreasing to half that diameter in the center region. Since the pitch is large, the tendency of the space charge rotating around the large diameter end portions of the cathode to control the oscillation and to result in coherent oscillation is forestalled. The effects of change in helix diameter are thus superimposed upon the effects of the wide pitch large diameter helical winding.

Figure 8:
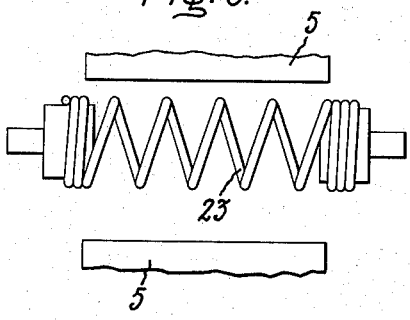

Referring now to FIG. 8, the cathode helix arrangement corresponding to that of FIG. 5 is shown in which a helix 23 is eccentric or off set with respect to the space charge chamber axis. Since the large cathode helix diameter and pitch are both maintained, the eccentricity adds to the field distortion.

Figure 9:
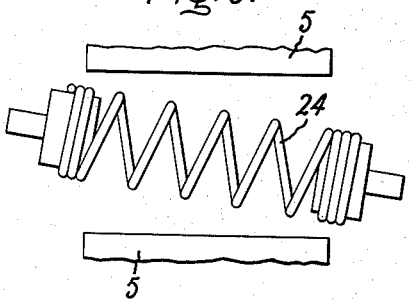

FIG. 9 illustrates another modification of the cathode assembly in which a cathode helix 24 corresponding to that of FIG. 5 is shown axially askew or tilted so that the axis of the cathode helix makes a small angle with respect to the space charge chamber axis. In this manner, further field distortion is introduced, and, if desired, the cathode may also be off-center or eccentric as in FIG. 8 for increased field distortion.

In the foregoing description it will be noted that the various cathode arrangements are characterized by the range and multiplicity of changes of cathode-to-anode spacing obtained by using a large diameter, wide pitch cathode helix which may be additionally modified to produce further field distortion. A broadly tuned output circuit and a dense space charge are also employed to increase the noise power output. While the cathode arrangements have been described with reference to a particular magnetron construction, it is obvious that other magnetrons in which the anode surrounds the cathode may be substituted. For example, the resonant system coupled to the anode segments may comprise cavity resonators incorporated in the anode structure.

While we have shown and described particular embodiments of our invention, it will be obvious to those skilled in the art that various changes and modifications may be made without departing from our invention and we therefore aim in the appended claims to cover all such changes and modifications as fall within the true spirit and scope of our invention.

What we claim as new and desire to secure by Letters Patent of the United States is:

1. A magnetron discharge device for noise generation comprising an elongated cathode and a plurality of anode segments surrounding said cathode to define a cylindrical space charge chamber, said cathode comprising a helix having a diameter equal to at least half the space charge chamber diameter and having a spacing between adjacent turns equal to at least half the helix diameter.

2. A magnetron discharge device for noise generation comprising an elongated cathode and a plurality of anode segments surrounding said cathode to define a cylindrical space charge chamber, said cathode comprising a helix having a diameter greater than half the space charge chamber diameter and having a spacing between adjacent turns greater than half the helix diameter.

3. A magnetron discharge device for noise generation comprising a helical cathode extending along a given axis and a plurality of anode segments surrounding said cathode to define a cylindrical space charge chamber therebetween, at least portions of said helical cathode having a diameter of at least half the space charge chamber diameter and having a spacing between adjacent turns equal to at least half the helix diameter.

4. A magnetron discharge device for noise generation comprising an elongated cathode extending along a given axis and an anode assembly comprising a plurality of spaced anode segments surrounding said cathode to form a cylindrical space charge chamber of a given length, said cathode comprising a wire helix having a diameter greater than half the space charge chamber diameter and having a helix pitch greater than half the helix diameter and not exceeding the space charge chamber length.

5. A magnetron discharge device for noise generation comprising helical wire cathode extending along a given axis and an anode assembly comprising a plurality of segments surrounding said cathode to define a cylindrical space charge chamber, at least portions of said helical cathode having a spacing between adjacent turns equal to at least half the cathode diameter to thereby impart substantial axial and radial asymmetry to the electric field produced in said space charge chamber when a potential is applied between said anode assembly and said cathode.

6. A magnetron discharge device for noise generation comprising an elongated cathode extending along a given axis and an anode assembly comprising a plurality of anode segments surrounding said cathode to form a cylindrical space charge chamber therebetween of a given length, said cathode comprising a wire helix having a diameter greater than half the space charge chamber diameter and a spacing between adjacent turns greater than half the helix diameter and not exceeding the space charge chamber length in order to produce substantial axial and radial electric field asymmetry when a potential is applied between said cathode and said anode assembly.

7. A magnetron discharge device for noise generation comprising an elongated cathode extending along a given axis and a plurality of anode segments surrounding said cathode to define a cylindrical space charge chamber therebetween, said cathode comprising a wide-pitched wire helix having a pitch equal to or greater than one-half the radius of said cylindrical space charge chamber and a conductive rod axially aligned within said helix and electrically connected therewith.

8. A magnetron discharge device for noise generation comprising an elongated cathode extending along a given axis and a plurality of anode segments surrounding said cathode to form a cylindrical space charge chamber therebetween, said cathode comprising a helix having a diameter equal to at least half the space charge chamber diameter and having a spacing between adjacent turns equal to at least half the helix diameter, and a conductive rod axially aligned within said helix spaced from the turns thereof.

9. A magnetron discharge device for noise generation comprising an elongated cathode extending along a given axis and a plurality of anode segments surrounding said cathode to define a cylindrical space charge chamber coaxial therewith, said cathode comprising a helix having a diameter equal to at least half the space charge chamber diameter and having a spacing between adjacent turns equal to at least half the helix diameter.

10. A magnetron discharge device for noise generation comprising an elongated cathode extending along a given axis and a plurality of anode segments surrounding said cathode to define a cylindrical space charge chamber having an axis parallel to said cathode axis and spaced therefrom, said cathode comprising a helix having a diameter equal to at least half the space charge chamber diameter and having a spacing between adjacent turns equal to at least half the helix diameter.

11. A magnetron discharge device for noise generation comprising an elongated cathode extending along a given axis and a plurality of anode segments surrounding said cathode to define a cylindrical space charge chamber having an axis which is askew with respect to said cathode axis, said cathode comprising a helix having a diameter equal to at least half the space charge chamber diameter and having a spacing between adjacent turns equal to at least half the helix diameter.

12. A direct high frequency noise generator including a magnetron discharge device for noise generation comprising an elongated cathode and a plurality of anode segments surrounding said cathode to define a cylindrical space charge chamber, said cathode comprising a helix having a diameter equal to at least half the space charge chamber diameter and having a pitch providing spacing between adjacent turns equal to at least half the helix diameter, means for impressing a unidirectional potential between said cathode and said plurality of anode segments to establish an electric field therebetween having axial and radial asymmetries introduced by the large cathode diameter and pitch, and a broadly tuned output system coupled to said plurality of segments.

13. A direct high frequency noise generator including a magnetron discharge device for noise generation comprising an elongated cathode and a plurality of anode segments surrounding said cathode to define a cylindrical space charge chamber, said cathode comprising a helix having a diameter equal to at least half the space charge chamber diameter and having a pitch providing spacing between adjacent turns equal to at least half the helix diameter, means for impressing a unidirectional potential between said cathode and said plurality of anode segments to establish an electric field therebetween having axial and radial asymmetries introduced by the cathode diameter and pitch, and a broadly tuned high decrement output system coupled to said plurality of segments.

14. A direct high frequency noise generator including a magnetron discharge device for noise generation comprising an elongated cathode and a plurality of anode segments surrounding said cathode to define a cylindrical space charge chamber, said cathode comprising a helix having a diameter equal to at least half the space charge chamber diameter and having a pitch providing spacing between adjacent turns equal to at least half the helix diameter, means for impressing a unidirectional potential between said cathode and said plurality of anode segments to establish an electric field therebetween having axial and radial asymmetries introduced by the cathode diameter and pitch, and a broadly tuned low decrement output system coupled to said plurality of segments.

* * * * *